US007047667B2

(12) United States Patent
Klavano

(10) Patent No.: US 7,047,667 B2
(45) Date of Patent: May 23, 2006

(54) COMPOSITE INSOLES WITH NATURAL PILE LAYER

(76) Inventor: Jim K. Klavano, 3628 E. Marginal Way S., Seattle, WA (US) 98134

( * ) Notice: Subject to any disclaimer, the term of this patent is extended or adjusted under 35 U.S.C. 154(b) by 320 days.

(21) Appl. No.: 10/617,644

(22) Filed: Jul. 10, 2003

(65) Prior Publication Data

US 2004/0020079 A1 Feb. 5, 2004

Related U.S. Application Data

(60) Provisional application No. 60/400,896, filed on Aug. 1, 2002.

(51) Int. Cl.
*A43B 7/06* (2006.01)
*A43B 7/08* (2006.01)
*A43B 13/20* (2006.01)

(52) U.S. Cl. ..... 36/3 R; 36/3 B; 36/141; 36/71; 36/29

(58) Field of Classification Search ..... 36/3 R, 36/3 B, 44, 141, 147, 71, 29, 30 R
See application file for complete search history.

(56) References Cited

U.S. PATENT DOCUMENTS 4,055,699 A * 10/1977 Hsiung ..... 36/44
4,192,086 A * 3/1980 Sichak ..... 36/44
4,257,176 A * 3/1981 Hartung et al. ..... 36/44
4,709,490 A * 12/1987 Fottinger et al. ..... 36/44
4,729,179 A 3/1988 Quist, Jr.
4,782,605 A 11/1988 Chapnick
4,864,740 A * 9/1989 Oakley ..... 36/44
4,887,368 A * 12/1989 Latzke ..... 36/44
4,942,679 A 7/1990 Brandon et al.
5,003,708 A 4/1991 Daley
5,203,793 A 4/1993 Lyden
5,204,173 A 4/1993 Canary
5,261,169 A * 11/1993 Williford ..... 36/44
5,388,349 A * 2/1995 Ogden ..... 36/44
5,400,526 A * 3/1995 Sessa ..... 36/3 B
5,529,826 A * 6/1996 Tailor et al. ..... 36/71
5,544,432 A 8/1996 Kita
5,718,064 A * 2/1998 Pyle ..... 36/3 B
5,727,336 A * 3/1998 Ogden ..... 36/44
5,753,357 A * 5/1998 Filipitsch et al. ..... 36/44
6,216,365 B1 4/2001 Cohen
D448,542 S 10/2001 Bryant
6,543,158 B1 4/2003 Dieckhaus
D474,588 S 5/2003 Dean

* cited by examiner

*Primary Examiner*—Anthony Stashick
(74) *Attorney, Agent, or Firm*—Garrison & Associates PS; David L. Garrison

(57) ABSTRACT

A comfortable, supportive odor absorbing insole covering the inner sole of footwear has a bottom inner sole engaging open cellular resilient cushion layer, impregnated with odor adsorbing chemicals such as activated charcoal zeolites, or silica gel, and a natural pile top layer such as lambskin shearling providing comfortable support and loft while protecting the foot or sock of the wearer against discoloration or irritation from the absorbent chemicals. The layers of the insole are laminated into integral unitary relation by heat sealing or by glue or binders which do not impede flow of air. The layers may also be simply stretched together. The alternating application and release of foot pressure on the insole, as when walking, will circulate air in the footwear into intimate contact with the chemical for absorption of moisture and destruction of foot odors.

16 Claims, 1 Drawing Sheet

COMPOSITE INSOLES WITH NATURAL PILE LAYER

CROSS-REFERENCE TO RELATED APPLICATION

This application claims benefit of U.S. Provisional Patent Application No. 60/400,896, filed Aug. 1, 2002, entitled "Composite Insoles with Natural Pile Layer."

FIELD OF THE INVENTION

This invention relates to the art of increasing the comfort of footwear while simultaneously destroying foot odors caused by perspiration and poor ventilation in the footwear. Specifically, the invention relates to laminated insoles having a layer of natural sheepskin over a layer of odor adsorbent material. The insole is shaped and sized to cover the inner soles of footwear and constructed to cushion the weight of the foot while simultaneously pumping air through odor adsorbing material embedded in a layer of the laminate.

BACKGROUND OF THE INVENTION

A variety of different types of footwear inserts have long been available in the art, and are generally provided for the purpose of adding comfort to the interior of the shoe, and as a means for overlying the insole, particularly in those styles of shoes that may use a hardening adhesive in order to apply these types of components to the shoe upper, or in the case of dress shoes, where nails may still be utilized for applying soles to the footwear, during their fabrication. More specifically, in the construction of boots, unless the sole is molded in situ to the boot upper, during its fabrication, nails are generally used for adhering the outsoles to the boots, during their fabrication. Hence, when these types of hard and roughened edges are disposed interiorly of the insole, it becomes necessary to provide some form of liner, to the interior of the shoe, in order to add to its comfort, and to shield the foot from exposure to these types of footwear assembly components.

Examples of prior art types of insoles can be seen in various previous patents that have issued. U.S. Pat. No. 4,729,179, issued to Quist, Jr., discloses a shoe insole, which amongst its various layers of foam, also includes a metal layer, as can be noted. This particular insole is designed to provide for rugged protection against the foot, through the addition of the metal layer, and that the remaining layers of foam, polyethylene film, and felt, are obviously present for comfort purposes.

U.S. Pat. No. 4,782,605, issued to Chapnick, discloses a shoe insert construction and method of making the same.

U.S. Pat. No. 4,942,679, issued to Brandon et al., discloses a styled comfort shoe construction. The insole for this particular designed shoe also includes a variety of layers of foam material, leather lining, and other filler materials, in which are cement-lasted to the shoe.

U.S. Pat. No. 5,003,708, issued to Daily, discloses a custom insole for an athletic shoe. This particular insole is more concerned with providing a significantly sized arch flange. Some of these flanges, or portions of the custom insole, are made of thermaformable materials.

U.S. Pat. No. 5,203,793, issued to Lyden, discloses aconformable cushioning and stability device for articles of footwear. This particular patent describes a conformable material which apparently achieves a solid matter state, after a working time, in order to enhance its conformance, the cushioning means is fabricated containing a variety of other components, such as a resilient layer of fluid material, in addition to a void that contains gas. This is not of similar construction to the insole insert of this current invention.

U.S. Pat. No. 5,204,173, issued to Canary, discloses a paperboard product and process that may be used for making shoe insoles.

U.S. Pat. No. 5,388,349, issued to Ogden, discloses another footwear insole that is defined as comprising an apertured top layer, for thermoconductive purposes. This particular insole, of this prior art patent, includes a first layer that is slip resistant, a non-absorbent, and thermally non-conductive component in its structure.

U.S. Pat. No. 5,544,432, issued to Kite, discloses an insole for shoes providing heel stabilization. This particular device simply includes means for heel stabilization, through the usage of an inner fabric layer, a side wall portion, and a cushioning material, which is apparently formed of some type of resilient putty particles, apparently for conformance purposes.

U.S. Pat. No. 5,718,064, issued to Pyle, discloses a multilayer sole construction for walking shoes. This is a multilayered insole, and it does contain a sock lining having a layer of shock absorbing material, in addition to a latex layer that is formed of humidity and odor absorbing material, including carbon particles, in addition to an upper layer that is of an open celled foam, and ergonomic of design. This liner also includes a foam layer, having a latex layer applied thereto, and which contains a plurality of carbon particles, and includes a foam layer of medium density having the ergonomic abilities, to provide high energy absorption.

U.S. Pat. No. 5,727,336, issued to Ogden, discloses a footwear insole with a moisture absorbent inner layer. This particular patent is very similar to, and comprises a continuation upon, the earlier Ogden U.S. Pat. No. 5,388,349. The insole of this particular patent is also formed in a related manner, having a first layer of slip-resistant material, and which is not absorbent, and includes thermally non-conductive attributes, within its structure.

These are representative examples of the prior art known to the applicant, and which, upon review, do not appear to incorporate either directly, or by suggestion, the components of this current invention as will be subsequently described.

SUMMARY OF THIS INVENTION

It is an object of this invention to provide a multilayer laminated insole for covering the inner soles of footwear.

Another object of this invention is to provide such an insole that can be used without decreasing the ease of inserting a foot into the footwear.

A further object of this invention is to provide such an insole with a foot cushioning layer that wicks moisture away from a user's foot.

Yet another object of this invention is to provide an insole with an odor and perspiration absorbing layer.

The insoles of this invention have an open cellular resilient cushion bottom layer, preferably foamed plastic materials such as polyurethane, natural or synthetic rubber latex, or similar open cellular resilient materials. This bottom cushion layer can have a relatively smooth bottom skin that rests against the inner sole of the footwear. This smooth skin serves to prevent buckling and wrinkling of the insole as pressure is applied during use.

The open cellular bottom cushion layer includes or is attached to an odor adsorbing and perspiration absorbing layer that is loaded or impregnated with an odor adsorbing chemical such as activated charcoal or silica gel. In another embodiment of the invention, the bottom cushion itself is loaded or impregnated with a foot odor adsorbing chemical such as activated charcoal or silica gel such that the bottom cushion layer is the odor and perspiration adsorbing layer. The bottom cushion layer has a high porosity and moisture absorbing capacity and exposes the carbon or other chemical particles therein to gases and vapors passing through the layer to destroy the bacteria and soak up the vapors.

The bottom layer is covered with a natural pile layer such as shearling (shorn sheepskin), which presents a comfortable and supportive top surface for the insole which will facilitate insertion of a bare foot or sock covered foot into footwear containing the insoles of this invention. The top layer protects the foot or sock against direct contact with the odor adsorbing and perspiration absorbing layer to avoid staining of the foot or sock and provides comfortable loft and support. This top layer also helps to wick perspiration moisture away from the user's foot and allows for air circulation under the foot. Additionally, the top layer protects the lower layer against abrasion.

As foot pressure is applied to and relieved from the insoles of this invention during normal use of footwear containing these insoles, the cells of the lower cushion layer are successively collapsed and expanded creating a pumping action to circulate air and vapors surrounding the foot in the footwear through the porous superimposed layers of the insole. This circulation draws the air and vapors into intimate contact with the charcoal or gel to effectively cause the chemicals to act on the odor producing bacteria while the bottom layer absorbs the moisture in the circulated air. The bottom layer although porous and sufficiently pliable to allow expansion and contraction will not compress completely to a flattened pore blocking condition under foot pressure such that air passages through the layer will be blocked. The various layers of the insole of this invention are bonded together by stitching or by adhesive binders.

The insoles of this invention provide multilayered-laminated footwear insoles with a lower layer impregnated with an odor adsorbing chemical, and a natural pile top layer. The top layer protects the foot or sock of a wearer against intimate contact with the chemicals while providing comfortable loft and wicking moisture away from the foot. The insole of the current invention pumps air into intimate contact with the chemicals when foot pressures are applied and relieved from the insole during normal use.

The current invention discloses a multiple layer laminated insole with a bottom layer composed of foam or the like, impregnated with activated charcoal or silica gel and a natural pile top layer, such as shearling, presenting a comfortable and supportive top surface.

The objects of this invention, as stated above, will become apparent to those skilled in this art from the following detailed description read in conjunction with the included drawings, which by way of a preferred example only illustrates one embodiment of this invention.

BRIEF DESCRIPTION OF THE DRAWINGS

The objects and features of the present invention, which are believed to be novel, are set forth in the appended claims. The present invention, both as to its organization and manner of operation, together with further objects and advantages, may best be understood by reference to the following descriptions, taken in conjunction with the accompanying drawings, wherein:

DESCRIPTION OF THE PREFERRED EMBODIMENT

Figure 1:
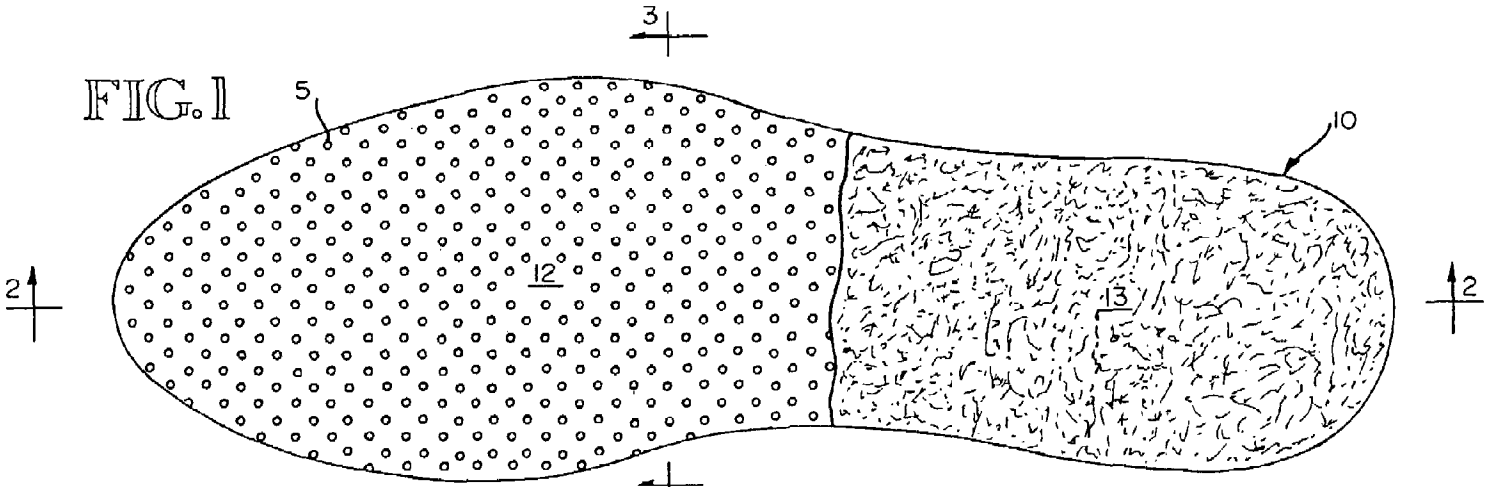
FIG. 1 is a top plan view, with parts broken away to show upper and lower layers of an insole according to this invention.
Figure 2:
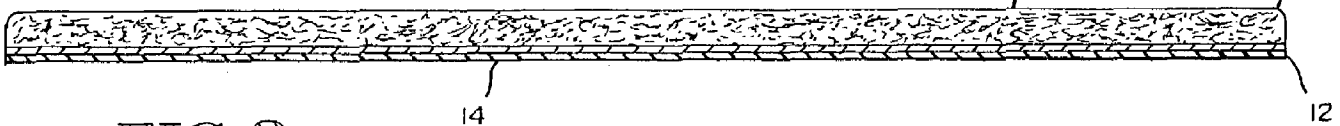
FIG. 2 is a longitudinal cross sectional view taken along the line II—II of FIG. 1.
Figure 3:
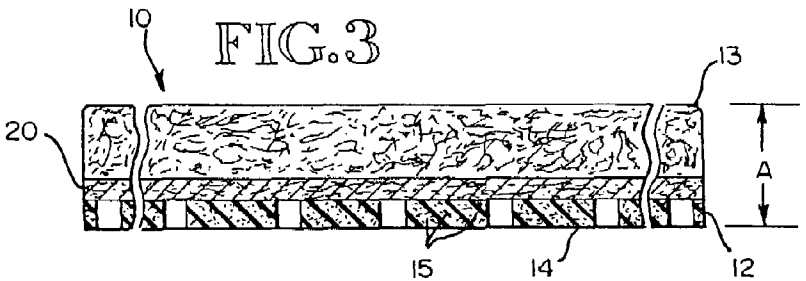
FIG. 3 is a transverse cross sectional view taken along the line III—III of FIG. 1 but with the thickness of the layers greatly enlarged for clarity.

Turning now to the drawings, the invention will be described in a preferred embodiment by reference to the numerals of the drawing figures wherein like numbers indicate like parts. The reference numeral 10 of FIGS. 1–4 illustrates a footwear insole according to this invention composed of a bottom layer 13, and a top layer 12 bonded together to form an integral laminate.

In a preferred embodiment, the bottom layer 12 is preferably an open cellular porous plastics foam sheet with a bottom skin 14 presenting a smooth bottom surface which may be less porous than the main body of the sheet. The bottom layer 12 has a myriad of open pores or cells 15 dispersed uniformly throughout the body thereof and has carbon particles, silica gel or other odor absorbing substances dispersed throughout.

The bottom layer 12 is resilient and has an uncompressed thickness of about ⅛ inches with acceptable thickness dimensions varying widely from about 1/32 inches to approximately ¼ inches. The foam sheet is conventionally formed on a smooth surface to provide the smooth skin 14. Polyurethane is a preferred foamed plastic material.

Additionally, at least one embodiment of the insoles of this invention has a plurality of small holes 5 communicating through the bottom layer 12 from bottom to top. The holes allow air to circulate freely through the insole, and they assist in creating an air pumping action as the insole is compressed under the weight of a user.

The top layer 13 is a thick comfortable natural pile such as a sheepskin shearling. The layer 13 is comfortable to the users' foot and provides loft and support. Typically the upper part is substantially vertically oriented wool fibers extending upwardly from a leather layer 20.

The bottom layer 12 and the top layer 13 are integrally bonded togther without closing off the natural permeability of the leather layer 20 at the bond areas because of the air pervious character of the bond. Heat sealing and use of non film forming binders are satisfactory. Latex binders are also suitable. The top layer 13 and the bottom layer 12 may also be sewn together around the periphery thereof.

Figure 4:
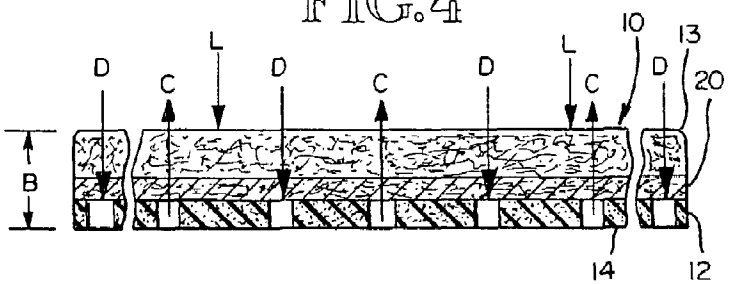
FIG. 4 is a view similar to FIG. 3 but showing the condition of the layers under foot pressure.

Referring to FIG. 4, when a foot load L are applied to the insole 10, as shown in the figure, the thickness of the insole may be reduced from A to B, with this reduction occurring in both the thickness of the bottom foam layer 12 and the upper pile layer 13. The lower foam layer typically may be compressed to about half of its free state thickness. Air in the pores 15 and the plurality of holes 5 in the bottom layer 12 is squeezed out of the layer as it is flattened. The air flows, as shown by the arrows C, such that the air is in intimate contact with the chemical particles and then through the pores in the leather surface 20 of the upper layer 13. Referring again to FIG. 4, when the load L is released the insole will expand from B to A. When the layers 12 & 13 expand, the air and vapors from the foot area will be drawn back through the upper layer 13 and the leather surface 20, as shown by arrows D, and into the bottom layer. Thus, a pumping action is created causing a circulation of air and vapors in the footwear around the foot of the wearer through the porous bottom layer 12 into repeated intimate contact with the odor absorbing chemical. The foot odor bacteria are neutralized and the foot perspiration is dried.

From the above descriptions, it will, therefore, be understood that this invention provides an insole for footwear composed of at least three layers, including a bottom open cellular cushion layer having absorbent chemicals which will absorb moisture and neutralized bacteria causing foot odors and a comfortable natural pile top layer. The layers are arranged so that foot pressure applied to and removed from the insole will effect a pumping of air through the structure to bring the air into intimate extensive contact with the chemical for efficient absorption of moisture and odors.

The insoles of the current invention are completely non abrasive and they conform to the foot of a user. The natural pile shearing layer allows air to circulate around a user's foot, wicks moisture away from the foot, and provides a cushioning effect. The lower layer also provides a cushioning effect while adsorbing moisture and odors.

The insoles disclosed herein can be worn in a variety of footwear types, with or without socks. When dirty, the insoles of the current invention can be cleaned with mild soap and water, and air dried.

INDUSTRIAL APPLICABILITY

The invention has applicability in the field of insoles for footwear. In particular the current invention describes a number of embodiments of odor and moisture adsorbing insoles.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

What is claimed is:

1. An insole comprising:

a lower layer made from an open cell resilient material;

said lower layer having top surface and a relatively closed pore smooth bottom surface;

said lower layer being impregnated with a foot-odor adsorbing chemical;

an upper layer made from a natural pile material, said upper layer being relatively thick and having a natural leather surface, said natural leather surface comprising said second surface of said upper layer;

said upper layer having a first surface and a second surface;

said second surface of said upper layer being attached to said top surface of said lower layer such that together said upper layer and said lower layer form a multilayer laminate;

whereby said insole has a shape that is complimentary to the inner sole of a plurality of types of footwear such that when said insole is placed inside a piece of footwear said smooth bottom surface of said lower layer rests on the inner sole of said piece of footwear and said inner sole is covered by said insole and when a user is wearing footwear having said insole inserted therein said insole alternately flattens and expands upon application and release of pressure on said insole thereby circulating air around a users foot and forcing air containing moisture and odors through said upper layer and into said lower layer where said air contacts said foot-odor adsorbing chemicals in said lower layer and foot odor causing bacteria is neutralized while any moisture is absorbed by said bottom layer.

2. The insole of claim 1 wherein said foot-odor adsorbing chemical is selected from the group consisting of activated charcoal, zeolite, and silica gel.

3. The insole of claim 1 wherein the said lower layer is composed of foamed plastic material.

4. The insole of claim 1 wherein said upper layer is composed of shearling and the lower layer of said insole is a thin foam layer whereby said lower layer is attached to said second surface of said upper layer.

5. The insole of claim 1 wherein said upper layer is attached to said lower layer with an adhesive.

6. The insole of claim 1 wherein said upper layer is attached to said lower layer by sewing said layers together.

7. The insole of claim 1 wherein said lower layer has a plurality of holes communicating from said top surface to said bottom surface such that said holes contain air when no pressure is being applied to said insole and said air is force out of said holes when said insole flattens upon application of pressure, thereby circulating air around the bottom of a users foot.

8. An insole comprising:

a lower layer made from an open cell resilient foamed plastic material;

said lower layer having top surface and a relatively closed pore smooth bottom surface;

said lower layer being impregnated with a foot-odor adsorbing chemical selected from the group consisting of activated charcoal, zeolite, and silica gel;

an upper layer made from a natural shearling pile material;

said upper layer having a pile surface and a natural leather surface;

said natural leather surface of said upper layer being attached to said top surface of said lower layer with an air porous bond such that together said upper layer and said lower layer form a multilayer laminate;

whereby said insole has a shape that is complimentary to the inner sole of a plurality of types of footwear such that when said insole is placed inside a piece of footwear said smooth bottom surface of said lower layer rests on the inner sole of said piece of footwear and said inner sole is covered by said insole and when a user is wearing footwear having said insole inserted therein said multilayer laminate alternately flattens and expands upon application and release of pressure on said insole thereby circulating air around a users foot and forcing air containing moisture and odors through said upper layer and into said lower layer where said air contacts said foot-odor adsorbing chemicals in said lower layer and foot odor causing bacteria is neutralized while any moisture is absorbed by said bottom layer.

9. The insole of claim 8 wherein said lower layer has an uncompressed thickness from about 1/16 to approximately 1/4 inch and said upper layer has a thickness of from about 1/4 to 1/2 inch.

10. The insole of claim 8 wherein said upper layer is attached to said lower layer with an adhesive.

11. The insole of claim 8 wherein said upper layer is attached to said lower layer by sewing said layers together.

12. The insole of claim 8 wherein said lower layer has a plurality of holes communicating from said top surface to said bottom surface such that said holes contain air when no pressure is being applied to said insole and said air is force out of said holes when said insole flattens upon application of pressure, thereby circulating air around the bottom of a users foot.

13. An insole comprising:

a lower layer made from an open cell resilient foamed plastic material;

said lower layer having an uncompressed thickness from about 1/16 to approximately 1/4 inch;

said lower layer having top surface and a relatively closed pore smooth bottom surface;

said lower layer being impregnated with a foot-odor adsorbing chemical selected from the group consisting of activated charcoal, zeolite, and silica gel;

an upper layer made from a natural shearling pile material;

said upper layer having a pile surface and a natural leather surface;

said upper layer has a thickness of from about 1/4 to 1/2 inch;

said natural leather surface of said upper layer being attached to said top surface of said lower layer with an air porous bond such that together said upper layer and said lower layer form a multilayer laminate;

whereby said insole has a shape that is complimentary to the inner sole of a plurality or types of footwear such that when said insole is placed inside a piece of footwear said smooth bottom surface of said lower layer rests on the inner sole of said piece of footwear and said inner sole is covered by said insole and when a user is wearing footwear having said insole inserted therein said multilayer laminate alternately flattens and expands upon application and release of pressure on said insole thereby circulating air around a users foot and forcing air containing moisture and odors through said upper layer and into said lower layer where said air contacts said foot-odor adsorbing chemicals in said lower layer and foot odor causing bacteria is neutralized while any moisture is absorbed by said bottom layer.

14. The insole of claim 13 wherein said upper layer is attached to said lower layer with an adhesive.

15. The insole of claim 13 wherein said upper layer is attached to said lower layer by sewing said layers together.

16. The insole of claim 13 wherein said lower layer has a plurality of holes communicating from said top surface to said bottom surface such that said holes contain air when no pressure is being applied to said insole and said air is force out of said holes when said insole flattens upon application of pressure, thereby circulating air around the bottom of a users foot.

* * * * *